US005743784A

United States Patent [19]

Birang et al.

[11] Patent Number: 5,743,784

[45] Date of Patent: Apr. 28, 1998

[54] APPARATUS AND METHOD TO DETERMINE THE COEFFICIENT OF FRICTION OF A CHEMICAL MECHANICAL POLISHING PAD DURING A PAD CONDITIONING PROCESS AND TO USE IT TO CONTROL THE PROCESS

[75] Inventors: Manoocher Birang, Los Gatos; John Prince, Los Altos, both of Calif.

[73] Assignee: Applied Materials, Inc., Santa Clara, Calif.

[21] Appl. No.: 574,501

[22] Filed: Dec. 19, 1995

[51] Int. Cl.[6] ..... B24B 7/22; B24B 53/02

[52] U.S. Cl. ..... 451/21; 451/443; 451/56

[58] Field of Search ..... 451/21, 443, 444, 451/56, 72

[56] References Cited

U.S. PATENT DOCUMENTS

| | | | |
|---|---|---|---|
| 5,036,015 | 7/1991 | Sandhu et al. | 451/1 |
| 5,069,002 | 12/1991 | Sandhu et al. | 451/41 |
| 5,081,051 | 1/1992 | Mattingly et al. | 451/56 |
| 5,456,627 | 10/1995 | Jackson et al. | 451/56 |

*Primary Examiner*—Robert A. Rose

*Attorney, Agent, or Firm*—Fish & Richardson, P.C.

[57] ABSTRACT

An apparatus and method for detecting the roughness of a CMP pad surface, in situ, during pad conditioning by measuring and making use of surface friction effects. The effect is advantageously exploited to determine an endpoint for the pad conditioning process i.e. when the surface roughness of the pad is within a desired range, to facilitate the qualification of conditioning process parameter changes by determining their effect on the conditioning process, and to optimize these parameters. Also, the effect is employed to measure non-uniformities in the pad's surface roughness, and to guide corrective measures. Generally, these objectives are accomplished using an apparatus which includes a floating head having its bottom surface in contact with the top surface of a rotating CMP pad undergoing a CMP pad conditioning process. A bracket is employed to restrain the floating head so as to prevent the head from moving along with the rotating CMP pad. A force sensing device is used to sense a restraining force exerted by the bracket on the floating head and to output a signal indicative of the restraining force. This restraining force is indicative of the friction between the floating head and the pad, and can be used to determine the coefficient of friction. The coefficient of friction is directly related to the surface roughness of the pad.

31 Claims, 8 Drawing Sheets

APPARATUS AND METHOD TO DETERMINE THE COEFFICIENT OF FRICTION OF A CHEMICAL MECHANICAL POLISHING PAD DURING A PAD CONDITIONING PROCESS AND TO USE IT TO CONTROL THE PROCESS

BACKGROUND

1. Technical Field

This invention relates to the manufacture of semiconductor devices, and more particularly, to an apparatus and method for controlling a chemical mechanical polishing (CMP) pad conditioning process using the coefficient of fiction of the pad.

2. Background Art

In the process of fabricating modern semiconductor integrated circuits (ICs), it is necessary to form various material layers and structures over previously formed layers and structures. However, the prior formations often leave the top surface topography of an in-process wafer highly irregular, with bumps, areas of unequal elevation, troughs, trenches, and/or other surface irregularities. These irregularities cause problems when forming the next layer. For example, when printing a photolithographic pattern having small geometries over previously formed layers, a very shallow depth of focus is required. Accordingly, it becomes essential to have a flat and planar surface, otherwise, some parts of the pattern will be in focus and other parts will not. In addition, if the aforementioned irregularities are not leveled at each major processing step, the surface topography of the wafer can become even more irregular, thereby exasperating the aforementioned problems as the layers stack up during further processing. Depending on the die type and the size of the geometries involved, the surface irregularities can lead to poor yield and device performance. Consequently, it is desirable to effect some type of planarization, or leveling, of the IC structures. In fact, most high density IC fabrication techniques make use of some method to form a planarized wafer surface at critical points in the manufacturing process.

One method for achieving the aforementioned semiconductor wafer planarization or topography removal is the chemical mechanical polishing (CMP) process. In general, the CMP process involves holding and/or rotating the wafer against a rotating polishing platen under a controlled pressure. The polishing platen is typically covered with a pad. This pad is used in conjunction with a chemical polishing slurry to polish, i.e. remove material from the wafer. The surface of the pad which interfaces with the wafer is usually either an open cell foamed polyurethane (e.g. Rodel IC1000), or a sheet of polyurethane with a grooved surface (e.g. Rodel EX2000). In either case, this surface is relatively rough so as to assist in the polishing process.

After a period of time, the pad becomes glazed due to the interaction between its polishing surface and the wafer. The surface features responsible for giving the pad its rough texture are blunted and reduced in size, or collapse under the pressure. This results in a degradation of the pad's ability to remove material from the surface of a wafer. Accordingly, the pad has to be periodically conditioned to restore its rough surface texture to ensure repeatable material removal rates in the CMP process. Customarily, the pad is conditioned after processing each wafer.

A common apparatus used to condition a pad is shown, in simplified form, in FIG. 1. The conditioning device 10 includes a conditioning head 12 which is held against the pad 14. The surface of the conditioning head 12 interfacing with the pad 14 is coated with a layer of diamond grit 16. The pad is supported by a platen 18. The pad material is typically wetted with an abrasive slurry to assist in the conditioning process. The platen 18 is usually rotated about its central axis 22. In addition, the conditioning head 12 is usually rotated about its central axis 24, and translated across the surface of the pad 14 via a translation arm 26. Of course, conditioning devices of other types and configurations are also employed to perform the pad conditioning process. For example, some use assemblies having conditioning rods, blades, pins, etc. The conditioning apparatus depicted in FIG. 1 is simply presented for exemplary purposes. The embodiments of the present invention described below are not limited to being used with the apparatus of FIG. 1, but can be employed in conjunction with any type of conditioning device.

It is noted that the aforementioned type of conditioning pad having an open cell foamed polyurethane construction must be pre-conditioned before use in a CMP process. Essentially, the cutting process used in the pad's manufacture glazes its surface and it needs to be roughened prior to use. The pre-conditioning entails performing the above-described pad conditioning process on the new pad.

A particular problem encountered during the conditioning of a CMP pad is in determining when the desired roughness has been restored to the pad. If the pad is conditioned too little, its removal rate will be less than expected, and if the pad is conditioned too long, pad material will be unnecessarily removed, thereby shortening its useful life. In the past, a trial and error method was used to determine the proper amount of conditioning time. However, due to the inaccuracies involved in the conditioning process, and because the chemical and mechanical properties of the pad material change with use, the same roughness cannot always be achieved by merely relying on time as a measure. Thus, the repeatability of the CMP process is adversely affected.

Accordingly, there is a need for a CMP pad conditioning apparatus and method which provide a more accurate determination of the roughness of the pad, in-situ, during the conditioning process, thereby assuring a consistent pad performance.

SUMMARY

The present invention is directed to a novel apparatus and method for detecting the roughness of a CMP pad surface, in situ, during pad conditioning, with an improved accuracy. The apparatus and method of the present invention generally measures and makes use of surface friction effects to accomplish this task. The effect is advantageously exploited to determine an endpoint for the pad conditioning process. In addition, this surface friction effect is employed to facilitate the qualification of conditioning process parameter changes and to optimize these parameters. Also, the effect is employed to measure non-uniformities in the pad's surface roughness, and to guide corrective measures.

Generally, the aforementioned objectives can be accomplished using an apparatus which includes a disk-shaped body having its bottom surface in contact with the top surface of a rotating CMP pad undergoing a CMP pad conditioning process. A bracket is employed to restrain the disk-shaped body so as to prevent it from moving along with the rotating CMP pad. A force sensing device is used to sense a restraining force exerted by the bracket on the disk-shaped body and to output a signal indicative of the restraining force. Another device causes the CMP pad conditioning device to terminate the ongoing CMP pad conditioning process whenever the output signal from the force sensing device indicates a prescribed threshold has been exceeded. The aforementioned restraining force is indicative of a frictional force produced by the interaction of the bottom surface of the restrained disk-shaped body and the top surface of the rotating CMP pad, and the prescribed threshold corresponds to a frictional force expected to be exhibited whenever the top surface of the CMP pad has been conditioned to a desired a surface roughness. However, it is preferred that a device for computing a coefficient of friction between the bottom surface of the disk-shaped body and the top surface of a rotating CMP pad also be included. This device uses the output signal from the force sensing device to determine this coefficient of friction. In this case, the prescribed threshold would correspond to a coefficient of friction expected to be exhibited whenever the top surface of the CMP pad has been conditioned to a desired a surface roughness. The apparatus also preferably includes a device for monitoring the output signal from the force sensing device and a device for analyzing the monitored output signal to determine if certain desired CMP pad conditioning process attributes are exhibited. Should the desired process attributes not be present, a device is included to modify certain CMP pad conditioning process parameters to produce the desired attributes.

A preferred version of the above-described apparatus has a bracket which includes a right angle portion having first and second arms which form an interior corner facing against the direction of rotation of the CMP pad. The disk-shaped body is disposed within the interior corner and restrained by these arms. The force sensing device in this case has first and second load cells. The first load cell is attached to the first arm of the bracket at a position coincident with a first point of contact of the disk-shaped body and the second load cell is attached to the second arm of the bracket at a position coincident with a second point of contact of the disk-shaped body. Preferably, this bracket is oriented such that a velocity vector associated with the rotating CMP pad as viewed from the center of the disk-shaped body bisects the angle formed by the interior corner of the bracket. Such an orientation stabilizes the disk-shaped body within the corner of the bracket and ensures a strong low noise signal from each load cell.

The disk-shaped body preferably has a floating head structure which includes a semiconductor wafer, one side of which forms the bottom of the head. This ensures that the frictional forces and coefficient of friction measured by the apparatus are consistent with those that would be encountered in a CMP process where the pad is used to planarize such a wafer. Thus, the coefficient of friction which is desired in the CMP process can be directly determined using the above-described apparatus according to the present invention.

An alternate version of the aforementioned apparatus employs a force sensing device which has a first and second tension sensor. Each of these tension sensors is attached to the bracket and has a filament extending therefrom. In turn, each filament is attached at its distal end to the disk-shaped body. The disk-shaped body is spaced from the bracket by the filaments in the direction of the rotation of the CMP pad. Thus, instead of the disk-shaped body being pushed against the bracket by the rotating pad, as in the previous versions of the invention, it is pulled away from the bracket by the pad in this version. Preferably, each filament is of equal length, the filament associated with the first tension sensor is attached to a top of the disk-shaped body at a point on the periphery thereof, the filament associated with the second tension sensor is attached to the top of the disk-shaped body at a point on the periphery thereof opposite the attachment point of the filament associated with the first tension sensor, and the filaments are equally spaced from each other over their entire lengths. This preferred configuration ensures the disk-shaped body is stabilized behind the bracket as the pad rotates. In this version, the output signal indicative of the restraining force is represented by a summation of tension forces sensed by the first and second tension sensors.

Although, the versions of the invention described so far have disk-shaped bodies which are held stationary over one radial position of the pad, this need not be the case. In another version of the invention, a translation arm is included. This arm is connected to the bracket and used to move it, along with the disk-shaped body, across the surface of the CMP pad in a generally radial direction. Preferably, this translation arm maintains the bracket in the aforementioned preferred orientation. In addition, it is preferred that the translation arm limits the movement of the disk-shaped body in the generally radial direction such that the peripheral edge of the disk-shaped body never overlaps the center of the CMP pad and never extends past the outer edge of the CMP pad.

As stated previously, the just-described versions of the apparatus can be used in several advantageous ways. One such method concerns controlling a chemical mechanical polishing (CMP) pad conditioning device to terminate the process and manipulate the process parameters. This method includes sensing a restraining force exerted by a bracket, outputting a signal indicative of the restraining force, and causing the CMP pad conditioning device to terminate an ongoing CMP pad conditioning process whenever the output signal indicates a prescribed threshold has been exceeded. In addition, the output signal can be monitored and analyzed to determine if desired CMP pad conditioning process attributes are exhibited. If not, at least a one CMP pad conditioning process parameters is modified to produce the desired process attributes. The desired attributes include a desired rate at which the CMP pad is conditioned to increase the pad's surface roughness. The process parameters include (i) the rotational velocity of the polishing pad, (ii) the rotational velocity of the conditioning head, (iii) a translational velocity between the conditioning head and the pad, (iv) a composition of the abrasive slurry, (v) the quantity of slurry used, (vi) the size of abrasive grit associated with the conditioning head, and (vii) the pressure between the polishing pad and a conditioning head.

Another advantageous method involves qualifying process parameter changes in a CMP pad conditioning process. The method includes the steps of performing a first conditioning process on a first pad employing a baseline set of process parameters, monitoring the surface roughness of the pad during the first conditioning process and outputting a signal indicative of the surface roughness of the first pad over time, terminating the first conditioning process when the output signal indicates the first pad exhibits the desired surface roughness, performing a second conditioning process on a second pad employing a modified set of process parameters, monitoring a surface roughness associated with the second pad during the second conditioning process and outputting a signal indicative of the surface roughness the pad over time, terminating the second conditioning process when the output signal indicates the second pad exhibits the desired surface roughness, and comparing the output signal associated with the first pad to the output signal associated with the second pad to determine the effects of the modified set of process parameters on the second conditioning process.

Still another method involves optimizing the pad conditioning process. Similar to the above method, this method includes the steps of performing a first conditioning process on a pad employing a set of baseline process parameters, monitoring a surface roughness of the pad during the first conditioning process and outputting a signal indicative of the surface roughness of the pad over time, and analyzing the output signal associated with the first conditioning process to determine if certain desired process attributes are exhibited. However, in this case, whenever the desired process attributes are not exhibited, at least one of the baseline process parameters is modified to create a modified set of process parameters which will produce the desired process attributes and all subsequent conditioning processes employ the modified set of process parameters.

The optimization method can also be performed during the conditioning process, rather than waiting for subsequent runs. In this case, the process attributes are monitored during the conditioning process and the appropriate parameters are modified if the desired attributes are not exhibited. The procedure is the same as described previously, except that after the parameters are modified, the optimization process is repeated until the output signal indicates the pad exhibits the desired surface roughness. At that point the conditioning is terminated.

Another advantageous method of the present invention involves using the previously described version of the apparatus which translates the disk-shaped body radially across the surface of the pad to detect and correct non-uniformities in the surface roughness of the pad. This method involves performing a conditioning process on a pad employing a set of baseline process parameters. The restraining force exerted by a bracket on a disk-shaped body is sensed to indicate the surface roughness of the pad. Specifically, the sensing step includes moving the bracket and disk-shaped body across the surface of the rotating CMP pad in a generally radial direction wherein the movement of the bracket and disk-shaped body tracks the radial position of a conditioning head, then generating a signal indicative of a surface roughness of the pad. Periodically, a value representative of the signal during a sweep is stored. These stored values correspond to the signal value for a particular radial position on the pad. The stored signal values for the sweep are compared and a difference between a highest stored signal value and the stored signal value for each of the particular radial positions on the pad is calculated. These calculated differences are then compared to a prescribed threshold difference. If a calculated difference exceeds the prescribed threshold difference, at least one of the baseline process parameters is modified when the conditioning head is located over the radial position on the pad corresponding to the position associated with the calculated difference exceeding the prescribed threshold. The modified process parameter are intended to produce an increased surface roughness in these positions. The process is then repeated. However, if the calculated differences do not exceed the prescribed threshold, the stored signal values are averaged to produce a value indicative of the average surface roughness of the pad. The averaged signal values are compared to a prescribed range representing a desired surface roughness range for the pad. If the averaged signal value does not fall within the prescribed range, the entire above-described process continues. But, if the averaged signal value exceeds the prescribed value, the conditioning process is terminated.

In all these methods the respective signals indicative of the surface roughness correspond to either a signal representing a frictional force produced by the interaction of the bottom surface of a disk-shaped body and a rotating top surface of the respective pads, or preferably to a signal representing a coefficient of friction between the bottom surface of the disk-shaped body and the rotating top surface of the respective pads.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

FIG. 2A is a side view and FIG. 2B is a partial top view.

DETAILED DESCRIPTION OF THE PREFERRED EMBODIMENTS

Preferred embodiments of the present invention will now be described with reference to the drawings.

Figure 1:
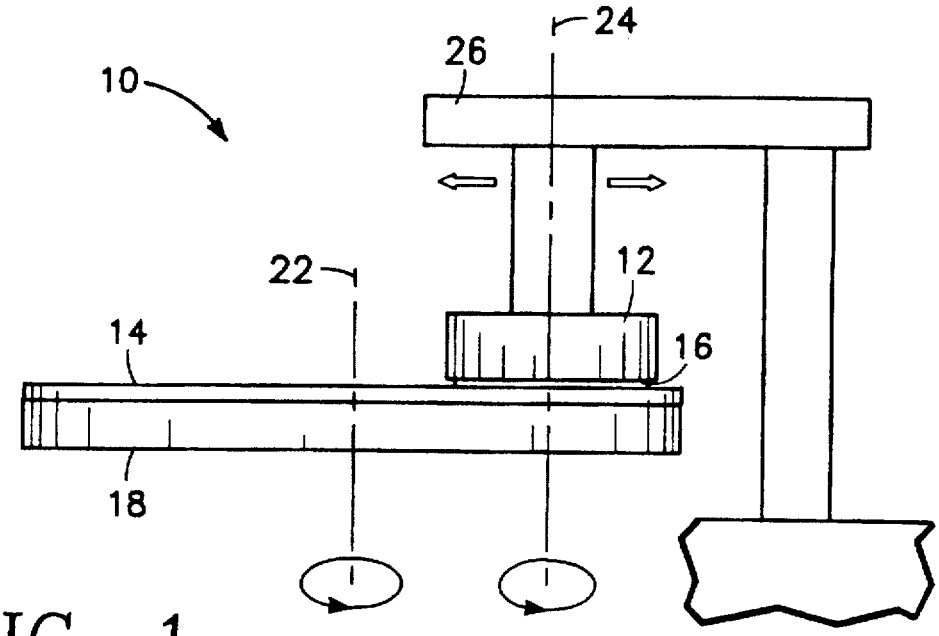
FIG. 1 PRIOR ART
FIG. 1 is a side view of a CMP pad conditioning device typical of the prior art.
Figure 2A:
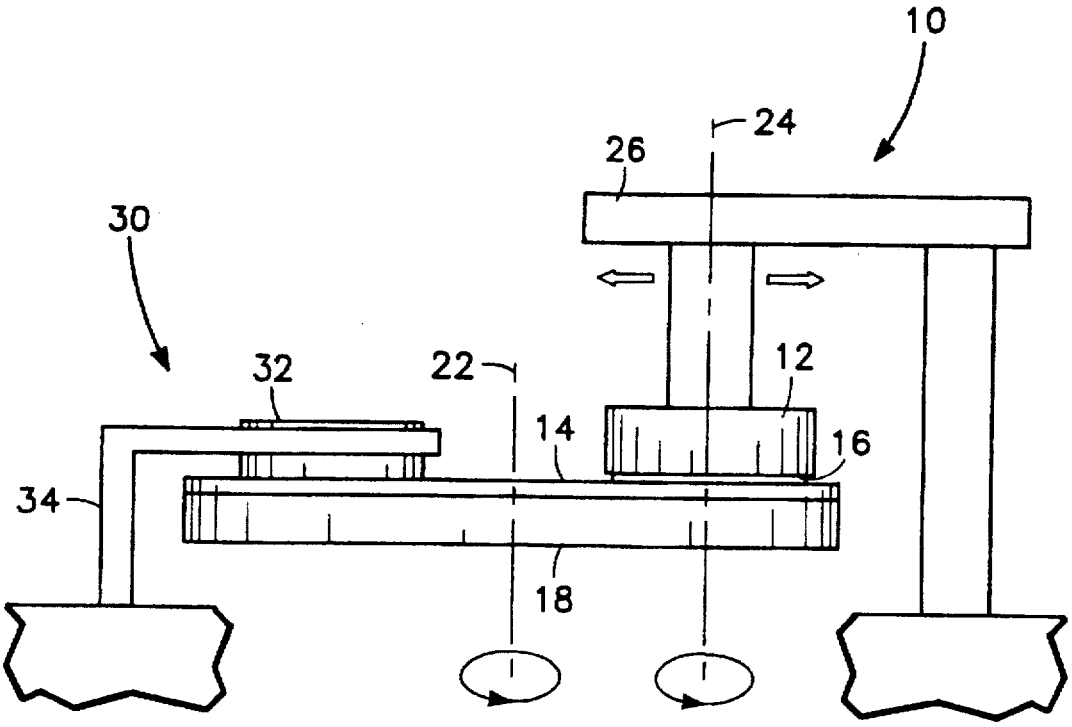
FIGS. 2A and 2B are simplified illustrations of one embodiment of an apparatus for detecting the surface roughness of the CMP pad via frictional effects in accordance with the present invention which employs a right angle restraining bracket.
Figure 2B:
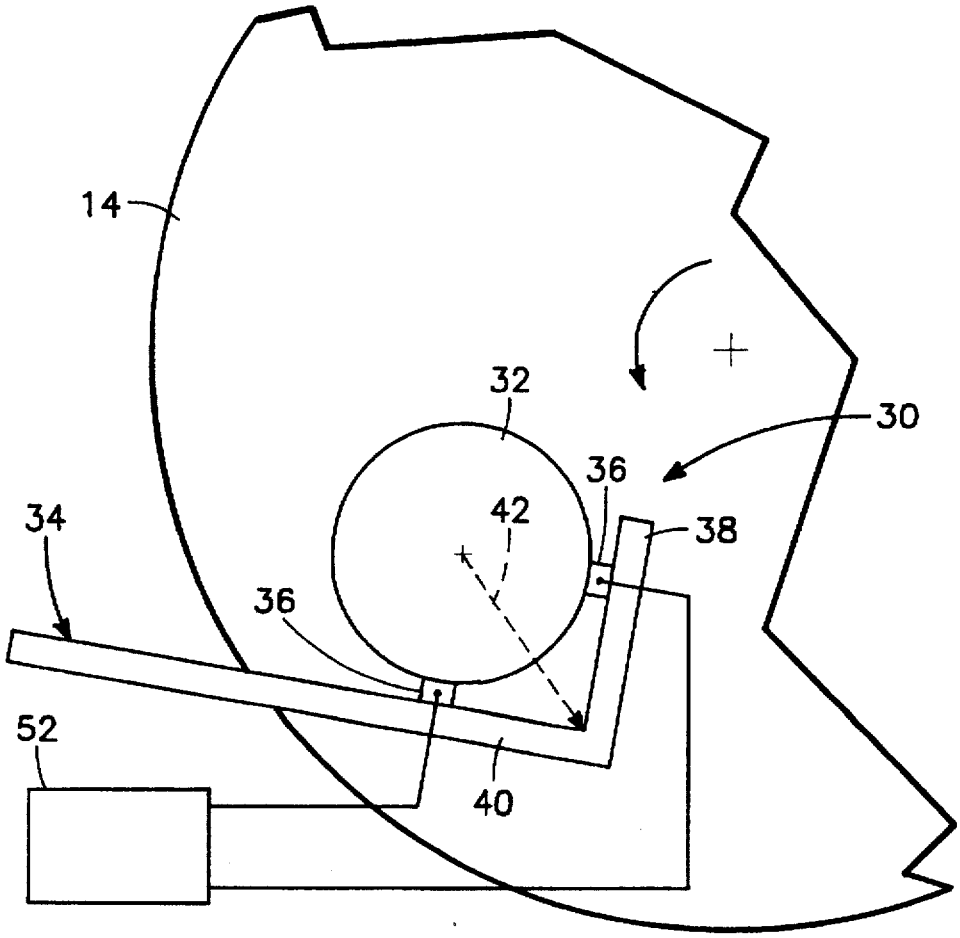

FIGS. 2A–B depict an embodiment of the present invention which employs a floating head apparatus 30 to determine the coefficient of friction of the surface of a polishing pad 14 undergoing conditioning. This floating head apparatus 30 is positioned away from the conditioning head 12 and translation arm 26 arrangement so as not to interfere with the conditioning process. For example, FIG. 2A depicts the floating head apparatus 30 as being on the opposite side of the platen 18 from the aforementioned conditioning head 12 and translation arm 26.

The floating head apparatus 30 has a free floating head 32 which is placed on the polishing pad 14. This head 32 has no direct connection to any other structure. The apparatus 30 also includes a right angle bracket 34 which is fixed to the base of the conditioning device. The bracket 34 cantilevers out over the platen 18 at a height sufficient to ensure it does not contact the rotating polishing pad 14. Load cells 36 are mounted to each of the bracket arms 38, 40 at the locations where the head 32 would normally contact them if placed up against the inside of the corner formed by these arms 38, 40, as shown in FIG. 2B. Thus, the position of the load cells 36 will vary depending on the diameter of the floating head 32. For example, the load cells 36 would preferably be centered at a location 3 inches away from the corner if a 6 inch diameter head is employed, and 4 inches away if an 8 inch diameter head is used. The load cells 36 can be any appropriate commercially available type which produces a signal indicative of the force exerted thereon.

The interior corner formed by the arms 38, 40 of the bracket 34 must face against the direction of platen rotation such that when the floating head 32 is placed against this corner, it is pushed against the arms 38, 40. In other words, the bracket 34 must be oriented in a way that the velocity vector 42, as viewed from the center of the head 32, divides the interior angle formed by bracket arms 38, 40. Although, the aforementioned angle could be divided into any proportion (e.g. 30°–60°, 20°–70°, etc.), it is preferred that the velocity vector 42 bisect the angle (i.e. 45°–45°), as depicted in FIG. 2B. Bisection is preferred because it tends to equalize the forces sensed by the load cells 36. This ensures that both cells 36 produces a strong, low noise signal. In addition, the preferred orientation of the bracket 34 tends to stabilize the floating head 32 so that constant contact is maintained while the platen 18 is rotating. As can be imagined, if the velocity vector 42 divided the interior bracket angle such that most or almost all of the divided angle was adjacent one arm, the force exerted on the load cell 36 associated with that arm would constitute most of the overall force exerted on the head 32 by the bracket 34. Accordingly, relatively little force would be exerted on the other arm, thereby creating a risk the head 32 might pull away from it in the presence of some counteracting force (such as for example a counteracting force produced by vibration).

Figure 3:
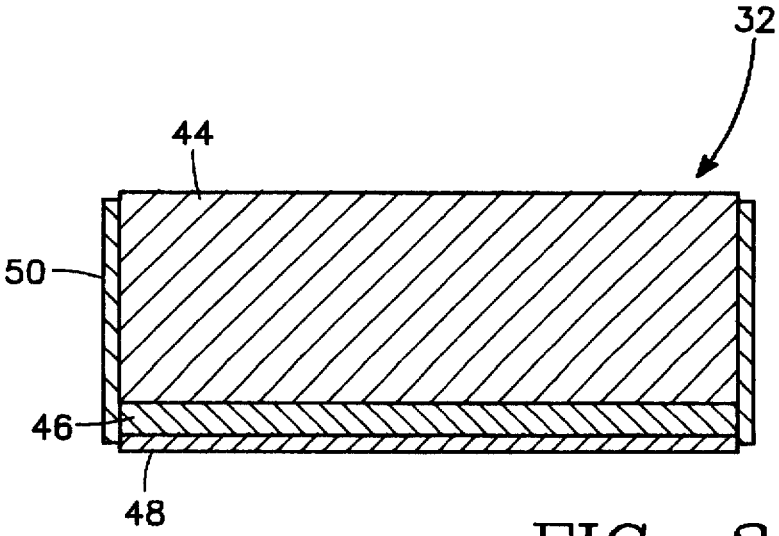
FIG. 3 is a cross-sectional view of the floating head employed in the embodiments of the present invention.

The floating head 32 is a disk or puck-shaped body, preferably constructed as shown in FIG. 3. This preferred head structure has a body portion 44, a carrier pad 46, a blank semiconductor wafer 48, and a retaining ring 50. The body portion 44 forms most of the physical size and weight of the head 32, and since it constitutes most of the height of the head 32, the body portion 44 should be thick enough to ensure the head 32 interfaces with the aforementioned load cells 36 on the bracket 34 (of FIG. 2B). The carrier pad 46 is simply employed to provide an interface between the body portion 44 and the wafer 48. One side of the carrier pad 46 is adhered to the bottom of the body portion 44, while the wafer 48 is place adjacent to the other side. The carrier pad 46 is made of a material which provides a coefficient of friction between it and the wafer 48 that exceeds the coefficient of friction between the wafer 48 and the surface of the polishing pad. This ensures the wafer 48 does not rotate in relation to the body portion 44 when the polishing pad is moving. In addition, the carrier pad 46 can have channels intersecting its surface facing the wafer 48. If so, the pad 46 is wetted prior to placing the wafer 48 against it. The combination of the channels and wetting results in a vacuum force which holds the wafer 48 against the carrier pad 46 even when the floating head structure is lifted. Finally, a retaining ring 50 is used to hold the body portion 44 and carrier pad 46 in horizontal alignment with the wafer 48. This ring 50 is required because the aforementioned frictional and vacuum forces between the carrier pad 46 and the wafer 48 are not sufficient to hold the wafer 48 in place when the polishing pad is rotating. The ring 50 preferably surrounds the aforementioned head components, but is not allowed to extend downward so as to completely cover the sides of the wafer 48. In this way, a part of the wafer 48 protrudes below the ring 50 so that the exterior face of the wafer 48 can come into contact with the polishing pad without interference from the retaining ring 50. The wafer 48 is used as the interface between the polishing pad and the floating head to mimic the conditions present in a CMP process where the polishing pad is used to planarize such a wafer. In this way, the coefficient of friction measured by the floating head apparatus (as will be more fully explained below) will directly correlate to that between the polishing pad and wafer being planarized in a CMP process. It is noted that the just-described floating head 32 corresponds to the structure of the polishing head used in a CMP apparatus. Therefore, this existing structure can be employed as the floating head 32.

Figure 4:
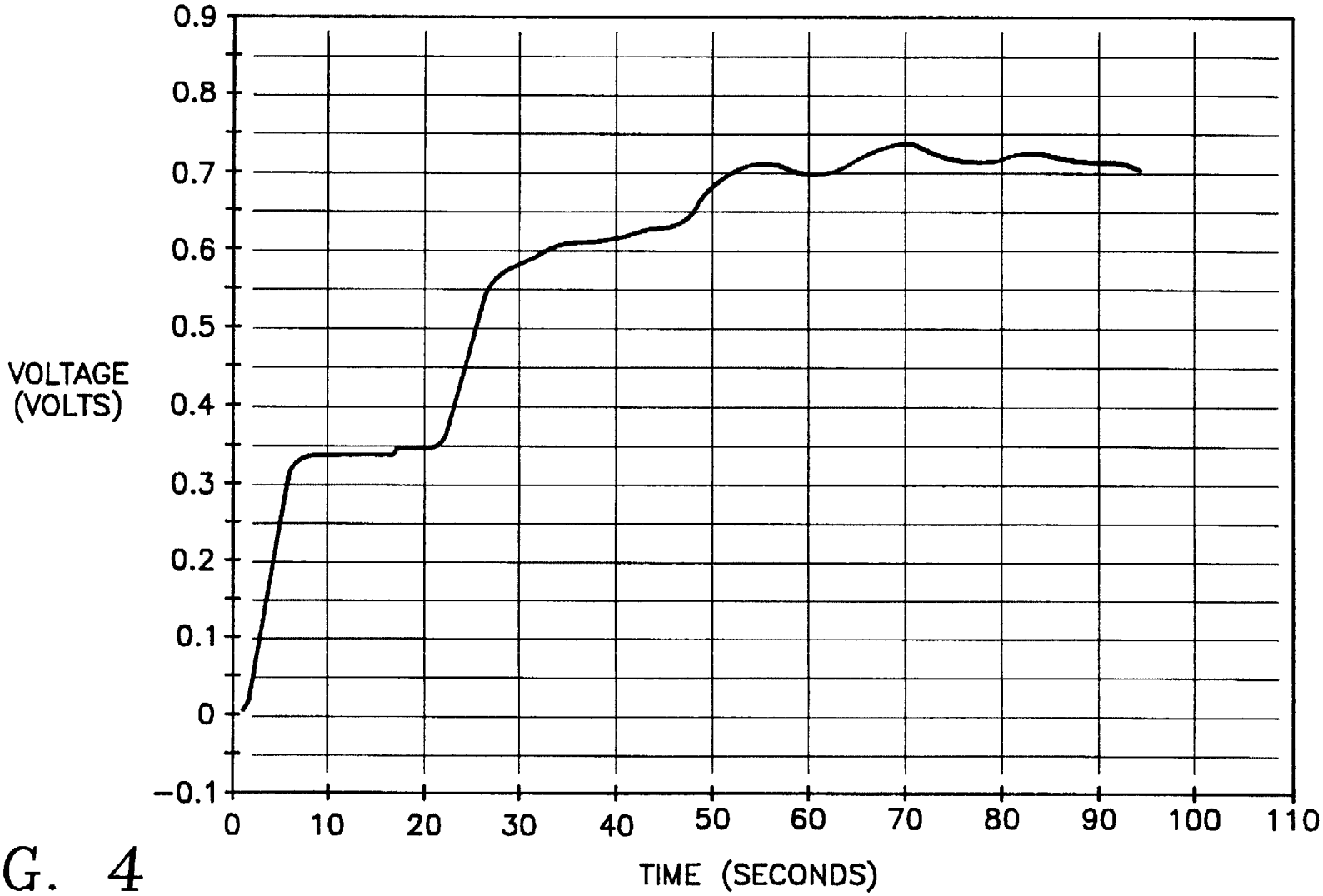
FIG. 4 is a graph representing the resultant force signal of the embodiment of FIGS. 2A and 2B plotted over time

Referring again to FIGS. 2A–B, during pad conditioning, the platen 18 is rotated and the free floating head 32 will be pushed up against the load cells 36 due to the friction between the polishing pad 14 and the head 32. Consequently, each load cell 36 will sense a force and provide a signal indicative of the sensed forces. If the bracket 34 is positioned in the aforementioned preferred orientation, the resultant force of the bracket on the head will be approximately:

$$F_R=0.707\ (F_X+F_Y) \tag{1}$$

where $F_R$ is the resultant force, $F_X$ is the force associated with bracket arm 38, and $F_Y$ is the force associated with bracket arm 40. Preferably, a processor 52 is employed to calculate this resultant force. As the polishing pad 14 is conditioned, the pad's surface becomes rougher, and so the friction between the floating head 32 and the pad 14 increases. This produces a gradual increase in the resultant force determined from the outputs of the load cells 36, as shown in FIGS. 4. FIG. 4 graphs the change in the voltage of a signal indicative of the resultant force over time, after filtering to smooth out cycling thought to be caused by small variations in the friction from one point on the polishing pad to the next as the platen rotates. This graph is representative of the change in the resultant force for a typical conditioning process. The initial rise in the signal corresponds to the platen coming up to speed, and the adjacent level portion represents the period of time prior to the conditioning head being lowered onto the pad. Thus, it can be seen that the conditioning process begins at approximately 20 seconds, and lasts for approximately 70 seconds. Once the conditioning head is lowered, it can be seen that the force increases and eventually levels off at about 50 seconds (i.e. 30 seconds into the illustrated conditioning process). As stated above, the increase in force is due to the increasing roughness of the pad's surface as the conditioning process proceeds. The leveling off of the force towards the end of the conditioning process indicates that a maximum surface roughness has been reached. During this phase of the conditioning process pad material continues to be removed, but no significant gain in roughness is achieved. This excess removal of material is undesirable because it reduces the effective life of the pad. Thus, it would be advantageous to terminate the conditioning process before pad material is unnecessarily lost, (i.e. after about 30 seconds of conditioning in the illustrated case). This could be accomplished by monitoring the voltage of a signal representing the resultant force, and when it equals or exceeds a predetermined threshold value (i.e. approximately 0.70 volts in the illustrated case), the conditioning process is terminated. In this way, the unnecessary removal of pad material is minimized. For example, in the conditioning process illustrated in FIG. 4, if the process were terminated at approximately 50 seconds, instead of approximately 90 seconds, 40 seconds of unnecessary material removal would be avoided. Given that the illustrated case is typical of current conditioning processes relying on time to set the endpoint, it is clear that the present invention can save significant amounts of processing time and extend the useful life of a polishing pad by terminating the process before excess material is removed.

However, the magnitude of the resultant force is tied to the weight of the floating head. Thus, a system relying on measuring the resultant force and comparing it to a threshold value would have to be reconfigured if a head having a different weight were employed. This problem can be avoided by using the coefficient of friction as the key indicator instead. The coefficient of friction ($\mu$) between the polishing pad and the wafer will essentially be given by the following equation:

$$\mu = F_R / W_H \quad (2)$$

where $W_H$ is the weight of the floating head. The coefficient of friction is an indicator of the surface roughness of the pad which is independent of increases or decreases in the head weight. For example, if the head weight were increased, this would result in a proportionate increase in the resultant force. However, the ratio of the two values, i.e. the coefficient of friction, would)stay the same. Accordingly, using the coefficient of friction to determine when the conditioning process should be terminated is preferred. It is also preferred that the aforementioned processor be used to calculate the coefficient of friction, as well as the aforementioned resultant force, and generate a signal indicative of the coefficient. This can be accomplished via well know methods which are not novel to the present invention, and so do not require further description herein.

Of course, there are some other second order factors involved in the above-described coefficient of friction relationship. However, they are for the most part insignificant and can be ignored for the applications associated with this invention, with one exception. The previously-described open cell foamed polyurethane class of polishing pads tend to exhibit a different coefficient of friction, depending on the speed of platen rotation. It is believed the change results from the effect of the slurry trapped in the cells of the pad. This phenomenon is not observed with the type of pad having sheet of polyurethane with a grooved surface. It is believed the grooves provide a pathway for the slurry to escape, thereby eliminating it as a factor. As such, the coefficient of friction remains constant with platen speed. The net effect of the variable coefficient of friction in the case of the open cell type pads is that the conditioning process on such a pad should preferably be conducted with the platen velocity expected to be employed in the CMP process. This ensures the measured coefficient of friction will correspond to the coefficient of friction desired for the CMP process.

The coefficient of friction between a new polishing pad and a semiconductor wafer is approximately 0.4–0.5. This is considered a desirable starting value for a CMP process. After the CMP process is complete, this coefficient typically drops to between 0.4 and 0.1. Accordingly, the goal of the pad conditioning process is to restore the pad to a roughness which produces the desired coefficient of fiction of approximately 0.4–0.5. This goal can be achieved by monitoring the processor signal indicative of the coefficient of friction, and terminating the conditioning process when the signal indicates the coefficient of friction falls within the desired range. In this way, the removal of unnecessary pad material and the processing time is minimized. The exact value which is used as the endpoint would be determined by the user and take into account such factors as the sensitivity and accuracy of the load cells and processor employed in the floating head apparatus.

It should also be pointed out the above-described floating head apparatus 30 (of FIGS. 2A–B) can be advantageously used for more than just a pad conditioning process endpoint detection system. For example, proposed changes to conditioning process parameters, such as conditioning head pressure and grit size, slurry characteristics and flow rate, platen and conditioning head rotation velocities, conditioning head translational velocity, and even the type of conditioning apparatus used, can be qualified with the aid of the floating head apparatus 30. Qualification would be accomplished by comparing the signal produced by the floating head apparatus 30 during a conditioning process, employing some prescribed baseline process parameters, with the signal produced from a conditioning process employing a different parameter or parameters. For instance, it is desirable to condition a polishing pad to a maximum prescribed surface roughness in the shortest period of time possible (and with a minimum amount of material removed). Thus, process parameter changes which are theorized to decrease the conditioning time necessary to achieve the desired roughness could be implemented and the resulting floating head apparatus signal compared to a signal derived from a process employing the previously used parameters. Since the above-described floating head apparatus signal provides an indication of when the maximum roughness is achieved and in what time period, this comparison will qualify whether the proposed changes had the desired effect. An example might be to increase the conditioning head pressure to determine if the conditioning time required to achieve the prescribed roughness with a minimum amount of pad material removed,.is shortened. Of course, this is just one example. The point is that by analyzing and comparing the signals output by the floating head apparatus 30, it is possible to quickly and efficiently assess the effect, good or bad, of any contemplated parameter change. If the proposed process parameter change(s) has the desired effect, it (they) can be retained for future conditioning processes.

In addition, rather than qualifying unknown effects of a parameter change, the aforementioned signal could also be used to fine tune or optimize the conditioning process. In other words, parameters having known effects would be manipulated to improve the process (of course, these known effects could have been determined by the above-described qualification method). For example, it is known that the chemical and mechanical characteristics of a polishing pad change with use. Thus, the conditioning parameters employed early in the life of a pad may no longer be optimum for an older pad. If, for instance, the time required to produced the prescribed pad surface roughness is deemed too slow when an "older" pad is conditioned, a process parameter change which is known to increase the conditioning rate (e.g. increasing head pressure) can be implemented to speed up the process on a subsequent conditioning of the pad. It is also pointed out that the aforementioned processor might be employed to control this parameter change. In this way, a feedback loop could be formed where the conditioning rate is determined, and if below a prescribed level, the appropriate processing parameter(s) is manipulated to increase the rate.

Figure 5:
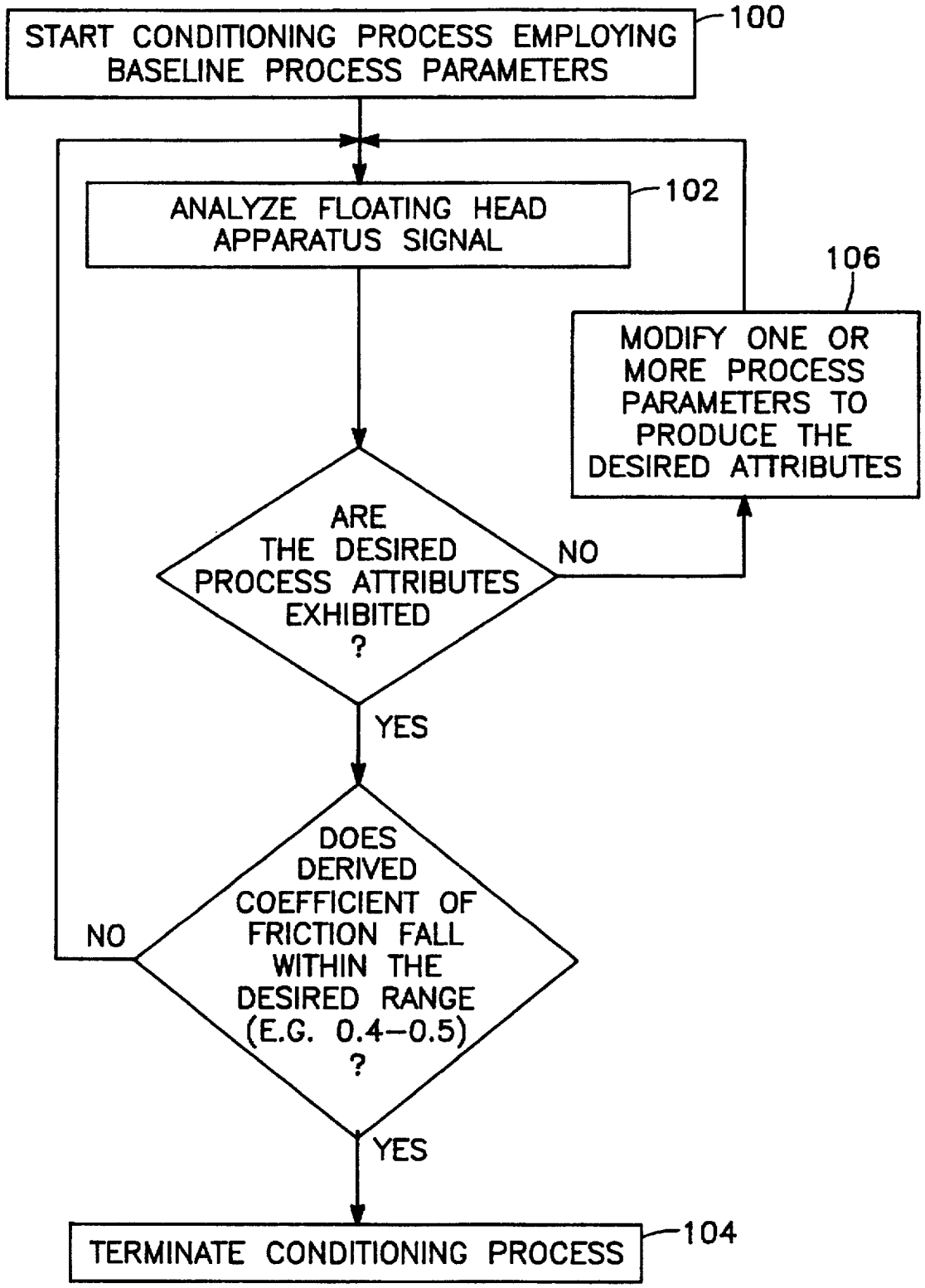
FIG. 5 is a block diagram of a method for optimizing CMP pad conditioning process parameters and terminating the process once the desired surface roughness range is reached, as evidence by the derived coefficient of friction.

If the aforementioned feedback loop is employed, process parameter changes amenable to being changed during the conditioning process itself could be implemented (e.g. conditioning head pressure, platen and conditioning head rotation velocities, etc.), rather than waiting for subsequent runs. Thus, for example, the aforementioned processor could be tasked to calculate the rate at which the pad is being conditioned by computing the rate of change of the coefficient of friction over a prescribed time period. If this rate is below a predetermined desired threshold rate, the appropriate parameter(s) would be changed to increase the rate. It is noted that logic circuitry or software programs capable of performing the above-described task are well known in the art. Accordingly, no detailed description is necessary herein. The above-described feedback control method associated with controlling the conditioning process attributes is generally illustrated in FIG. 5. The method begins with a step 100 where the a set of baseline process parameters is employed to initiate the conditioning process. During the process, the floating head apparatus signal is analyzed, in analysis step 102, to determine if the desired process attributes are exhibited (e.g. conditioning rate, etc.). If they are, then the process continues, using the baseline parameters, until the aforementioned endpoint is detected and the process is terminated (step 104), or the process attributes change and the desired attributes are not exhibited. In the case where the desired attributes are not exhibited, one or more of the aforementioned process parameters are manipulated (step 106) in a way which is known to drive the conditioning process towards the desired attributes. The process then continues, with the analysis step 102 being continuously repeated and the parameter(s) being further modified (step 106) as necessary, until the endpoint is detected and the process terminated (step 104).

Figure 6:
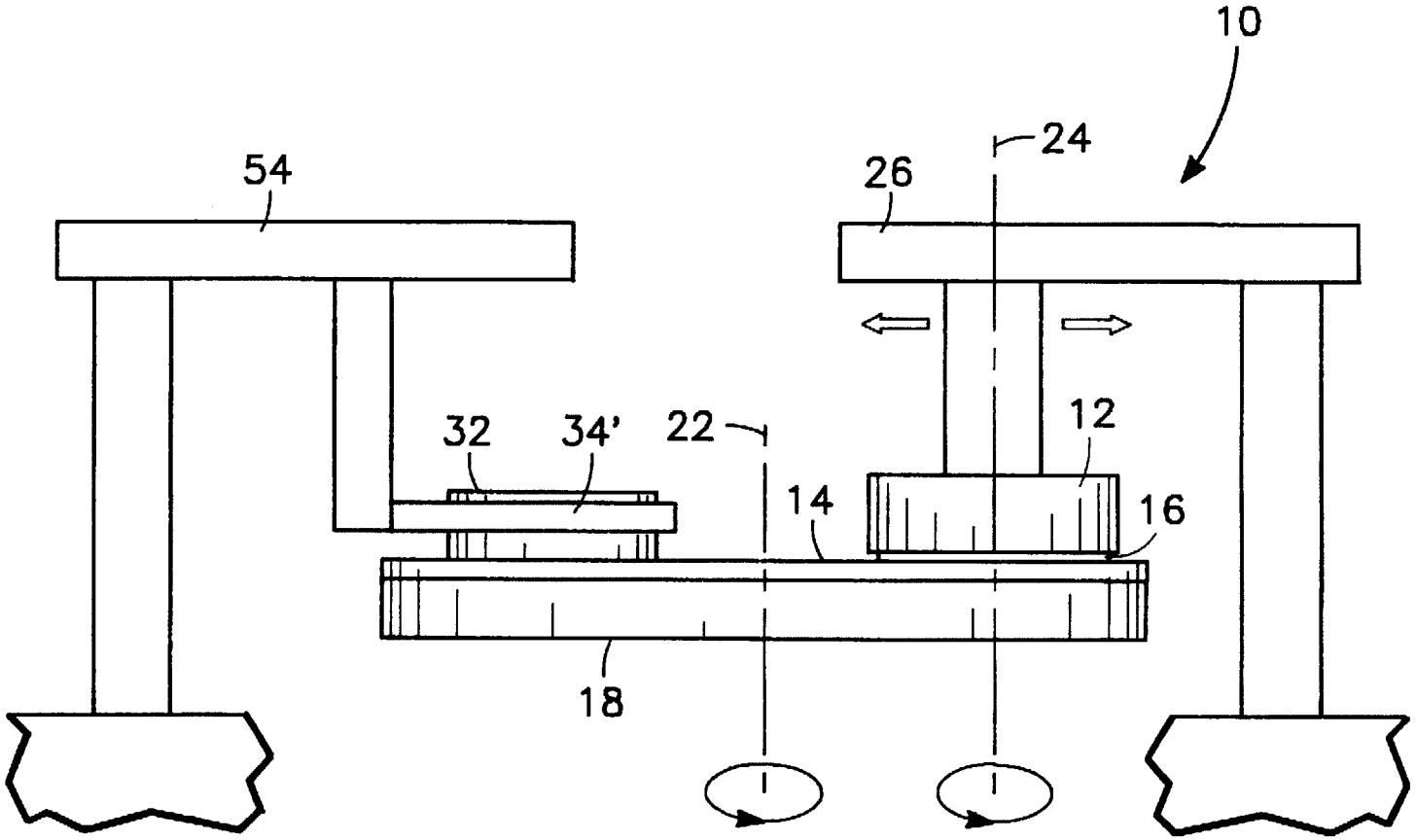
FIG. 6 is a simplified illustration of an embodiment of FIGS. 2A and 2B modified to include a translating arm structure.

Yet another use for an in-process feed-back control loop would be to determine the uniformity of the pad's surface roughness and perhaps even take corrective measures if it exceeds a desired degree of uniformity. Due to the mechanical nature of-the previously-described conditioning devices, there is a possibility that the surface roughness of a conditioned pad will not be uniform from one point to the next. This non-uniformity, if extreme, could result in inconsistent or unsatisfactory results When the pad is used in a CMP process. The uniformity of the pad undergoing conditioning can be determined using a modified embodiment of the floating head apparatus. As shown in FIG. 6, the apparatus has been modified to incorporate a translation arm 54. This arm 54 moves the floating head 32 and bracket assembly 34' linearly across the pad 14 as it rotates. Preferably, the head 32 and bracket 34' are moved in a way that the previously-described preferred orientation in respect to the velocity vector of the platen is maintained. In addition, it is preferred that the translation arm 54 move the head 32 and bracket 34' assembly along a linear path between a first point where the peripheral edge of the floating head 32 is adjacent the center of the pad 14 and a second point where the peripheral edge of the head 32 is adjacent the outside edge of the pad 14, and that the head 32 not be allowed to overlap the pad's center or extend out beyond the edge of the pad 14.

Figure 7A:
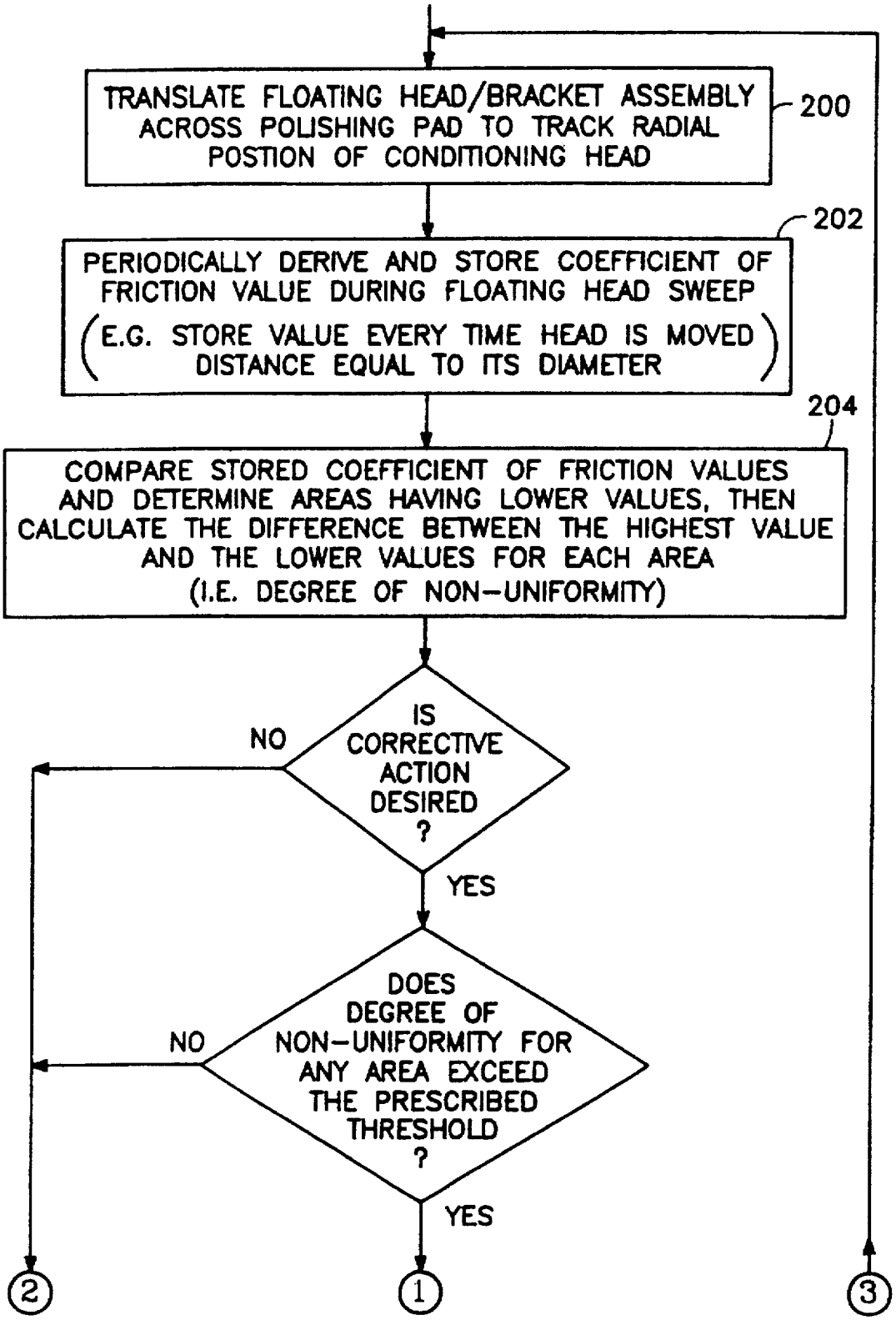
FIGS. 7A and 7B are is a block diagram of a method for detecting and correcting non-uniformities in CMP pad surface roughness and terminating the process once a desired uniform surface roughness range is reached.
Figure 7B:
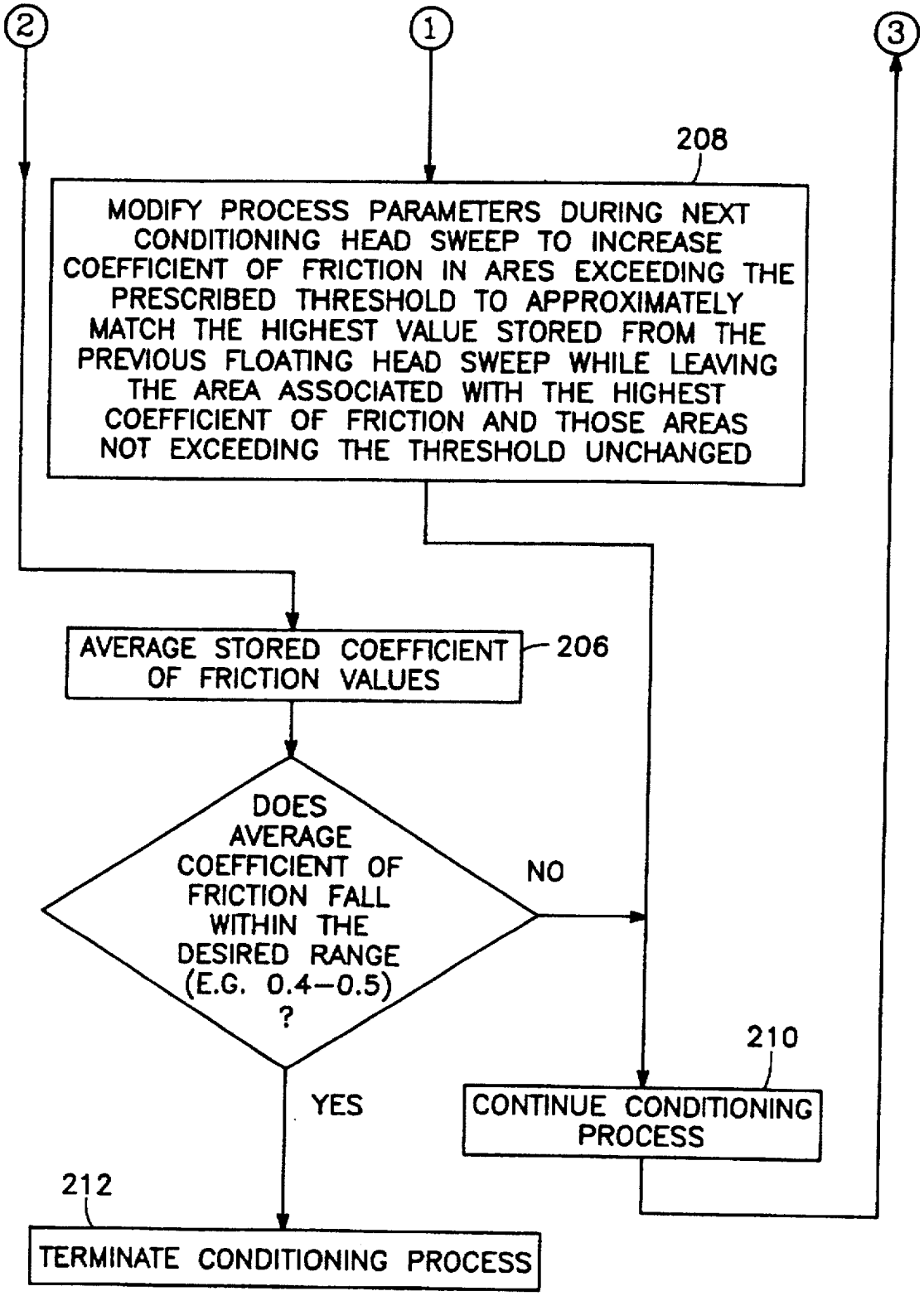

Referring to FIGS. 6, 7A and 7B, one method of using the above-described modified embodiment to determine the uniformity of a pad 14 undergoing conditioning is to cause the floating head 32 to translate across the surface of the pad 14 in such a way that it mimics the movements of the conditioning head 12 (step 200). In other words, the floating head 32 would always be approximately the same distance away from the center of the pad 14 as the conditioning head 12. The processor 52 (of FIG. 2B) would be used to periodically store a signal value indicative of the coefficient of fiction between the floating head 32 and the pad 14 at predetermined locations in along the head's path across the pad 14 (step 202). For example, such a value might be stored each time the head 32 traverses a length equal to its diameter. After each sweep of the floating head 32 across the pad, the processor 54 would compare the stored valued and determine which areas of the pad have lower coefficient's of friction in comparison to the highest stored value, and calculate a difference between the highest value and the lower value for each area (step 204). If it is not desired to take corrective action to produce a uniform surface roughness during the process, or if the degree of non-uniformity (i.e. the difference between the stored coefficient of friction value and the lower values for each area) does not exceed some desired predetermined threshold, the average coefficient of friction for the sweep would be calculated (step 206) and used in determining the process endpoint, or to qualify/optimize process parameter, as discussed earlier. If, however, it is desired and necessary (i.e. the prescribed non-uniformity threshold is exceeded) to take corrective action to produce a more uniform surface roughness, the processor 54 would be used to modify the appropriate process parameters so as to increase the coefficient of friction between the pad 14 and the head 32 in those areas of the pad 14 determined to exceed non-uniformity threshold, to approximately match the highest stored value from the previous sweep. Meanwhile, the area having the highest coefficient and the areas not exceeding the threshold are left unchanged during the next sweep (step 208). Therefore, the next sweep becomes a corrective sweep. For example, the conditioning head 12 and its translation arm 26 could be put under the control of the processor to cause the conditioning head 12 to dwell for an appropriate amount of time at a location on the pad which requires additional conditioning to make the associated coefficient of friction consistent with the area having the highest coefficient, during the next sweep of the conditioning head 12 across the pad (step 208). Of course, this is just one example. Process parameters, other than just dwell time, could also be modified to increase the coefficient of friction (and so the surface roughness) in the appropriate locations to match the region having the highest coefficient for the previous sweep. For instance, the rotational velocity of the pad 14 and/or conditioning head 12 could be increased. Additionally, the conditioning head pressure could be increased. Regardless of which parameters are employed, the goal is the same, namely, to produce a uniform surface roughness, as indicated by the coefficient of friction, across the surface of the pad 14. At the end of the corrective sweep, the normal conditioning process is continued (step 210) and the above-described uniformity monitoring and correction process (steps 200, 202, 204, and 206 or 208) is repeated for the next sweep of the conditioning head 12. If the aforementioned averaged coefficient of friction value (step 206) is to be used to determine the endpoint of the conditioning process, the process is terminated when the averaged value falls within the desired coefficient range (step 212). However, if the averaged value does not fall within the desired range, the conditioning process is continued (step 210). It is noted that, here again, processor methods for performing the above-described task are well known in the art. Accordingly, no further description is necessary.

Figure 8:
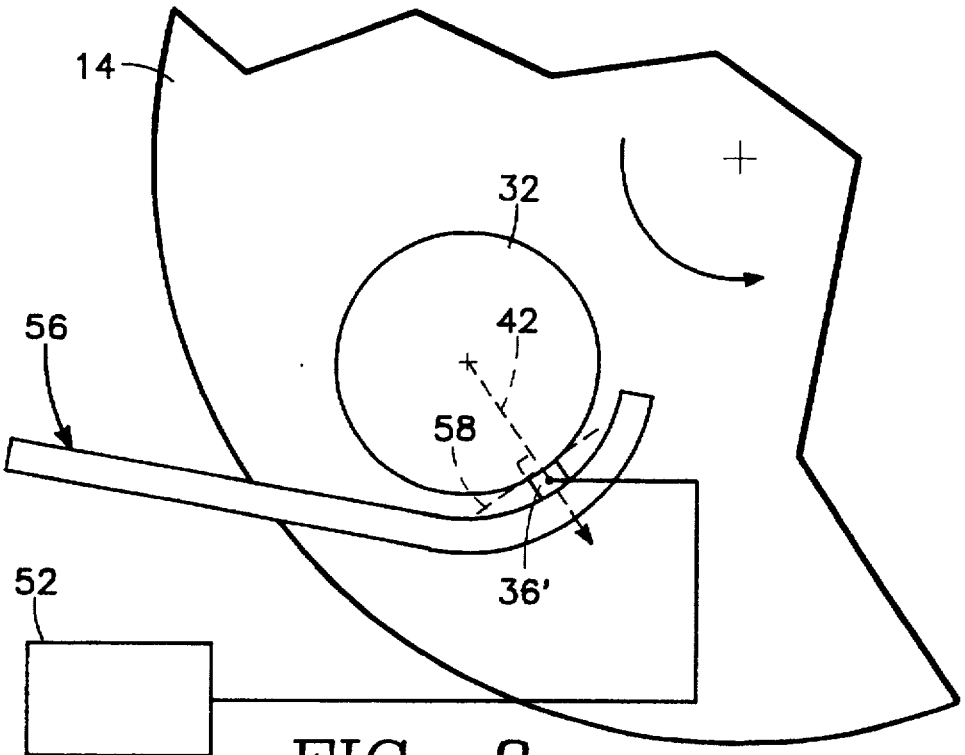
FIG. 8 is a simplified illustration of an embodiment of an apparatus for detecting the surface roughness of the CMP pad via frictional effects in accordance with the present invention which employs a curved restraining bracket.

The dual load cell configuration of the apparatus of FIGS. 2A–B was employed to ensure the stability of the floating head 32. However, this configuration did require a resultant force to be calculated from the outputs of the two load cells 36. FIG. 8 shows an alternate embodiment of the present invention which would employ just one load cell 36' connected to a curved bracket 56. The curved bracket 56 is shaped and oriented such if the platen were rotating the floating head 32 would contact the bracket 56 at a point where the velocity vector 42 of the platen perpendicularly intersects an imaginary line 58 drawn tangent to the head 36', as shown in FIG. 8. The load cell 36' is attached to the bracket 56 at this point. As can be seen, the force sensed by the single load cell 36' would be equivalent to the calculated resultant force described earlier. However, the single point of contact between the bracket 56 (via the load cell 36') and the floating head 32, makes the head 32 very susceptible to being pulled away from the cell 36' by a counteracting force (such as one caused by vibration). Additionally, this single load cell concept is not a good candidate for the previously-described embodiment involving the sweeping head apparatus (of FIG. 6). The frictional force on the head 32 caused by the motion of the bracket 56 as it translates radially across the pad surface would tend to dislodge the head 32 from the load cell 36'. Accordingly, even though the single load cell embodiment simplifies the floating head apparatus, it is not preferred.

Figure 9:
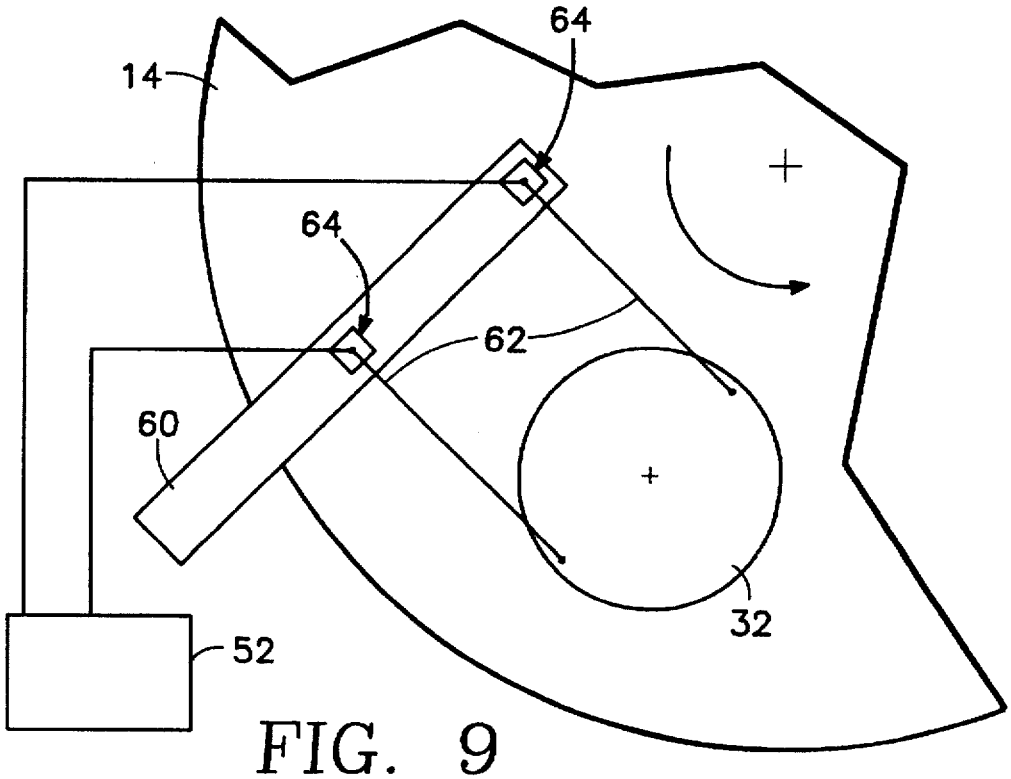
FIG. 9 is a simplified illustration of an embodiment of an apparatus for detecting the surface roughness of the CMP pad via frictional effects in accordance with the present invention which employs a tethered floating head.

In all the previously described embodiments of the floating head apparatus of the present invention, the floating head is not connected in anyway to the other structures. It simply is pushed up against the bracket by the friction between the head and the pad. An alternate embodiment of the apparatus employs a floating head 32 which is attached to a bracket structure 60, as shown in FIG. 9. In this alternate embodiment the head 32 is tethered to the bracket 60 by two lanyard-like filaments 62, each of which forms part of a tension sensor 64. The other components of the tension sensors 64 are attached to the bracket structure 60. The bracket structure 60 is fixed to the base of the conditioning apparatus and cantilevers out over the pad 14 at a height sufficient to preclude it touching the pad 14, similar to the brackets associated with previously-described embodiments of the invention. The two filaments 62 are used to hold and stabilize the head 36 as it rides behind the bracket 60 as the platen rotates. As such, it is necessary that the floating head apparatus be positioned so that the friction between the head 36 and the pad 14 caused by the rotation of the platen creates tension in the filaments 62. The distance between the filaments 62 is made large enough to minimize any lateral motion of the head 36. As such, the filaments 62 are preferably attached at opposite sides of the top of the head 36, as shown in FIG. 9. In addition, the other ends of the filaments 62 are attached to the respective remaining parts of the tension sensor 64 with a separation distance equal to that associated with their attachment to the head 36. It is believed this attachment scheme provides maximum stability for the head 36. Each tension sensor 64 senses part of the frictional force created between the head 36 and the rotating pad 14, and generates a signal indicative of these forces. The two signals are summed to create a combined signal representing the previously-described resultant force, preferably in the aforementioned processor 52. In all other aspects this alternate embodiment operates identically to previous embodiments, and can be used for the same purposes. However, it is pointed out that this alternate floating head apparatus may not be ideally suited for embodiments involving sweeping the floating head across surface of the pad. The fictional forces created by the sweeping motion could laterally destabilize the floating head 36, thereby producing errors in the coefficient of friction calculations of a specific area of the pad 14. As such, the first-described floating head apparatus 30 (of FIGS. 2A–B) employing the dual load cell scheme is preferred for the sweeping head embodiment (FIG. 6) of the present invention.

While the invention has been described in detail by reference to the preferred embodiment described above, it is understood that variations and modifications thereof may be made without departing from the true spirit and scope of the invention. For example, the disclosed apparatus and method for detecting pad roughness could be employed, in-situ, during the CMP process itself to ascertain the when the roughness of the pad drops below some predetermined value. The CMP process could then be terminated and the pad conditioned.

Wherefore, what is claimed is:

1. An apparatus for controlling a chemical mechanical polishing (CMP) pad conditioning device, comprising:

(a) a disk-shaped body having a bottom surface in contact with a top surface of a rotating CMP pad undergoing a CMP pad conditioning process;

(b) a bracket for restraining the disk-shaped body so as to prevent the disk-shaped body from moving along with the rotating CMP pad;

(c) force sensing means for sensing a restraining force which is exerted by the bracket on the disk-shaped body and which is substantially parallel to the top surface of the CMP pad, the force sensing means generating an output signal indicative of the restraining force; and (d) means for causing the CMP pad conditioning device to terminate the CMP pad conditioning process whenever the output signal from the force sensing means indicates a prescribed threshold has been exceeded.

2. The apparatus of claim 1, wherein the restraining force is indicative of a frictional force produced by an interaction of the bottom surface of the disk-shaped body and the top surface of the rotating CMP pad and the prescribed threshold corresponds to a frictional force expected to be exhibited whenever the top surface of the CMP pad has been conditioned to a desired surface roughness.

3. The apparatus of claim 1, wherein:

(a) the bracket comprises a right angle portion having a first arm and a second arm which form an interior corner facing against the direction of rotation of the CMP pad, the disk-shaped body being disposed within the interior corner and restrained by the arms; and (b) the force sensing means comprises a first load cell and a second load cell, the first load cell being attached to the first arm of the bracket at a position coincident with a first point of contact of the disk-shaped body and the second load cell being attached to the second arm of the bracket at a position coincident with a second point of contact of the disk-shaped body.

4. The apparatus of claim 3, wherein the bracket is oriented such that a velocity vector associated with the rotating CMP pad as viewed from a center of the disk-shaped body bisects an angle formed by the interior corner of the bracket.

5. The apparatus of claim 1, further comprising:

(a) means for computing a coefficient of friction between the bottom surface of the disk-shaped body and the top surface of the rotating CMP pad using the output signal from the force sensing means; and wherein (d) the prescribed threshold corresponds to an expected coefficient of friction which is expected to be exhibited whenever the top surface of the CMP pad has been conditioned to a desired surface roughness.

6. The apparatus of claim 5, wherein the disk-shaped body comprises a floating head structure including a semiconductor wafer and the bottom surface of the disk-shaped body corresponds to an exterior facing surface of the wafer.

7. The apparatus of claim 6, wherein the expected coefficient of friction is within a range of 0.4 and 0.5.

8. The apparatus of claim 1, further comprising:

(a) means for analyzing the output signal to determine if desired CMP pad conditioning process attributes are exhibited.

9. The apparatus of claim 8, further comprising means for modifying CMP pad conditioning process parameters to produce the desired process attributes whenever the analyzing means indicates the desired process attributes are not exhibited.

10. The apparatus of claim 9, wherein the modifying means modifies the process parameters during the CMP pad conditioning process.

11. The apparatus of claim 1, wherein:

(a) the force sensing means comprises a first tension sensor and a second tension sensor, each tension sensor being attached to the bracket and having a filament extending therefrom; and wherein (b) each filament is attached at a distal end to the disk-shaped body and the disk-shaped body is spaced from the bracket by the filaments in the direction of the rotation of the CMP pad.

12. The apparatus of claim 11, wherein:

(a) each filament is of equal length;

(b) the filament associated with the first tension sensor is attached to a top of the disk-shaped body at a point on a periphery thereof and the filament associated with the second tension sensor is attached to the top of the disk-shaped body at a point on the periphery thereof opposite the attachment point of the filament associated with the first tension sensor; and (c) the filaments are equally spaced from each other over their entire lengths.

13. The apparatus of claim 11, wherein the output signal indicative of the restraining force is generated by summing tension forces sensed by the first and second tension sensors.

14. The apparatus of claim 3, further comprising:

a translation arm connected to the bracket for moving the bracket and the disk-shaped body across the top surface of the CMP pad in a generally radial direction.

15. The apparatus of claim 14, wherein the translation arm maintains the bracket in an orientation such that a velocity vector associated with the rotating CMP pad at a center of the disk-shaped body continuously bisects an angle formed by the interior corner of the bracket.

16. The apparatus of claim 14, wherein the translation arm limits movement of the disk-shaped body in the generally radial direction such that a peripheral edge of the disk-shaped body never overlaps a center of the CMP pad and never extends past an outer edge of the CMP pad.

17. An apparatus for controlling a chemical mechanical polishing (CMP) pad conditioning device, comprising:

(a) a body having a bottom surface positionable in contact with a top surface of a rotating CMP pad during a CMP pad conditioning process;

(b) a bracket for restraining the body so as to prevent it from moving along with the rotating CMP pad;

(c) a sensor to measure a restraining force which is exerted by the bracket on the body and which is substantially parallel to the top surface of the CMP pad, the sensor generating an output signal indicative of the restraining force; and (d) circuitry configured to cause the CMP pad conditioning device to terminate the CMP pad conditioning process whenever the output signal from the sensor exceeds a prescribed threshold.

18. The apparatus of claim 17 wherein the circuitry comprises a programmed processor.

19. The apparatus of claim 17, wherein the circuitry is configured to compute a coefficient of friction between the bottom surface of the body and the top surface of the rotating CMP pad using the output signal from the sensor, and wherein the prescribed threshold corresponds to a coefficient of friction which is expected to be exhibited whenever the top surface of the CMP pad has been conditioned to a desired surface roughness.

20. The apparatus of claim 19, wherein the body comprises a floating head structure including a semiconductor wafer and the bottom surface of the body corresponds to an exterior facing surface of the wafer.

21. An apparatus for controlling a chemical mechanical polishing (CMP) pad conditioning device, comprising:

(a) a body having a bottom surface positionable in contact with a top surface of a rotating CMP pad during a CMP pad conditioning process;

(b) a bracket for restraining the body so as to prevent it from moving along with the rotating CMP pad, the bracket including a right angle portion having a first arm and a second arm which form an interior corner to face against the direction of rotation of the CMP pad, the body being disposed within the interior corner and restrained by the arms;

(c) a sensor to measure a restraining force which is exerted by the bracket on the body and generating an output signal indicative of the restraining force, the sensor comprising a first load cell and a second load cell, the first load cell being attached to the first arm of the bracket at a position coincident with a first point of contact of the body and the second load cell being attached to the second arm of the bracket at a position coincident with a second point of contact of the body; and (d) circuitry configured to cause the CMP pad conditioning device to terminate the CMP pad conditioning process if the output signal from the sensor indicates a prescribed threshold has been exceeded.

22. The apparatus of claim 21, wherein the bracket is oriented such that a velocity vector associated with the rotating CMP pad at a center of the body bisects an angle formed by the interior corner of the bracket.

23. The apparatus of claim 21, further comprising:

a translation arm connected to the bracket for moving the bracket and the body across the top surface of the CMP pad in a generally radial direction.

24. The apparatus of claim 23, wherein the translation arm maintains the bracket in an orientation such that a velocity vector associated with the rotating CMP pad at a center of the body continuously bisects an angle formed by the interior corner of the bracket.

25. The apparatus of claim 23, wherein the translation arm limits movement of the body in the generally radial direction such that a peripheral edge of the body never overlaps a center of the CMP pad and never extends past an outer edge of the CMP pad.

26. An apparatus for controlling a chemical mechanical polishing (CMP) pad conditioning device, comprising:

(a) a body having a bottom surface positionable in contact with a top surface of a rotating CMP pad during a CMP pad conditioning process;

(b) a bracket for restraining the body so as to prevent it from moving along with the rotating CMP pad;

(c) a sensor to measure a restraining force which is exerted by the bracket on the body and generating an output signal indicative of the restraining force; and (d) circuitry configured to compute a coefficient of friction between the bottom surface of the body and the top surface of the rotating CMP pad using the output signal from the sensor, and to cause the CMP pad conditioning device to terminate the CMP pad conditioning process if the output signal from the sensor indicates a prescribed threshold has been exceeded, wherein the prescribed threshold corresponds to an expected coefficient of friction which is expected to be exhibited whenever the top surface of the CMP pad has been conditioned to a desired surface roughness.

27. The apparatus of claim 24, wherein the body comprises a floating head structure including a semiconductor wafer and the bottom surface of the body corresponds to an exterior facing surface of the wafer.

28. The apparatus of claim 27, wherein the expected coefficient of friction is within a range of 0.4 and 0.5.

29. An apparatus for controlling a chemical mechanical polishing (CMP) pad conditioning device, comprising:

(a) a body having a bottom surface positionable in contact with a top surface of a rotating CMP pad during a CMP pad conditioning process;

(b) a bracket for restraining the body so as to prevent it from moving along with the rotating CMP pad;

(c) a sensor to measure a restraining force which is exerted by the bracket on the body and generating an output signal indicative of the restraining force, the sensor including a first tension sensor and a second tension sensor, each tension sensor being attached to the bracket and having a filament extending therefrom which is attached at a distal end to the body so that the body is spaced from the bracket by the filaments in the direction of the rotation of the CMP pad; and (d) circuitry configured to cause the CMP pad conditioning device to terminate the CMP pad conditioning process if the output signal from the force sensing means indicates a prescribed threshold has been exceeded output signal from the sensor exceeds a prescribed threshold.

30. The apparatus of claim 19, wherein:

(a) each filament is of equal length;

(b) the filament associated with the first tension sensor is attached to a top of the body at a point on a periphery thereof and the filament associated with the second tension sensor is attached to the top of the body at a point on the periphery thereof opposite the attachment point of the filament associated with the first tension sensor; and (c) the filaments are equally spaced from each other over their entire lengths.

31. The apparatus of claim 29, wherein the output signal indicative of the restraining force is generated by summing tension forces sensed by the first and second tension sensors.

* * * * *